United States Patent [19]

Ohnari et al.

[11] Patent Number: 4,697,566

[45] Date of Patent: Oct. 6, 1987

[54] METHOD OF CONTROLLING ELECTRONIC FUEL INJECTION TO INTERNAL COMBUSTION ENGINE

[75] Inventors: Mikihiko Ohnari, Tokyo; Motohisa Funabashi, Sagamihara; Makoto Shioya, Tokyo; Teruji Sekozawa, Kawasaki; Masami Shida, Mito, all of Japan

[73] Assignee: Hitachi, Ltd., Tokyo, Japan

[21] Appl. No.: 927,938

[22] Filed: Nov. 7, 1986

[30] Foreign Application Priority Data

Nov. 13, 1985 [JP] Japan ..... 60-252723

[51] Int. Cl.[4] ..... F02D 41/22

[52] U.S. Cl. ..... 123/479; 364/431.11

[58] Field of Search ..... 123/479, 481, 630, 198 D, 123/198 F; 364/431.11

[56] References Cited

U.S. PATENT DOCUMENTS 3,834,361 9/1974 Keely ..... 123/479

4,049,957 9/1977 Kera et al. ..... 123/479 X

FOREIGN PATENT DOCUMENTS 124028 7/1983 Japan ..... 123/479

108847 6/1984 Japan ..... 123/479

2104247 3/1983 United Kingdom ..... 123/479

OTHER PUBLICATIONS

"BMW Reveals V12 Details" from *Autocar*, Mar. 4, 1987, p. 6.

*Primary Examiner*—Tony M. Argenbright

*Attorney, Agent, or Firm*—Antonelli, Terry & Wands

[57] ABSTRACT

A method of controlling fuel injection to an internal combustion engine by electronic circuits. A plurality of cylinders installed in the internal combustion engine are divided into two groups and two electronic circuits for controlling the respective two cylinder groups are provided. By comparing between the outputs of the two electronic circuits, whether the operations of the respective electronic circuits are normal or not is judged. The fuel injection controlled by the electronic circuit which has been judged to be abnormal is stopped, while the fuel injection controlled by the electronic circuit which has been judged to be normal is continued. Thus, the internal combustion engine is driven solely by one group of cylinders.

2 Claims, 2 Drawing Figures

METHOD OF CONTROLLING ELECTRONIC FUEL INJECTION TO INTERNAL COMBUSTION ENGINE

BACKGROUND OF THE INVENTION

The present invention relates to a method of controlling electronic fuel injection to an internal combustion engine and, more particularly, to a method of controlling fuel injection having high reliability which enables an engine to be constantly driven without being stopped by a trouble of a part of an electronic circuit.

The number of electronic parts mounted on an automobile has recently been increased, which tendency involves a fear of lowering the reliability of a car as a whole. If an electronic part of a fuel injection system is out of order and the engine is stopped, it is not easy to trace the fault and repair on the road, so that there is no alternative but to call a mechanic. If a trouble is caused in an unfrequented place, it puts a fellow passenger to much trouble. Furthermore, if a trouble which makes it impossible to run the car is caused while carrying a very important person even in a big city, there is a fear of incurring a great social and economical loss.

A conventional mechanical supply system composed of a carburetor scarcely causes sudden trouble and, in most cases, malfunction is gradually sensed and foreseen, so that the reliability of the carburetor system is secured by preventive maintenance and routine checkup. As to the reliability of electronic parts, if initial failure is eliminated by accelerated test, there remains only a probability of the rest of the parts generating random failure. In order to prevent the breakdown of the whole system due to a random failure of an electronic part which constitutes an electronic circuit, a method of allowing redundancy on the level of parts, circuits and system is often adopted.

A method of allowing redundancy on the level of parts and circuits is lacking in practicality because cost is raised due to increase in the number of parts, the decision circuit for judging the quality of parts and circuits is not always reliable, and the system becomes complicated by the incorporation of a defective part identifying circuit and an alarm circuit. If a redundancy system is adopted, a defective part must be replaced immediately in order to preserve the characteristic of the redundancy system. In order to maintain the reliability, it is desirable that immediately after a trouble is caused, a certain extent of burden is put to the driver, thereby urging the driver to replace the defective part.

SUMMARY OF THE INVENTION

Accordingly, it is an object of the present invention to provide what is called a fault tolerant method of controlling electronic fuel injection which enables an engine to be driven, incomplete as it is, without being completely stopped when a part of an electronic circuit has some trouble.

For example, the internal combustion engine of an automobile is able to be driven at a low torque when the fuel injection and ignition are carried out for only half the cylinders intalled. Notice has been taken of this fact, and the present invention has been achieved on the basis of this finding. To state this more concretely, two pairs of electronic circuits for controlling fuel injection and ignition are prepared. Each pair of circuits are so constituted as to charge the control of half the cylinders installed. In the normal state, the engine system is operated while ascertaining the synchronism and reasonableness check of both pairs of circuits, but when abnormality takes place, the engine is driven only by the normal part of circuits.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
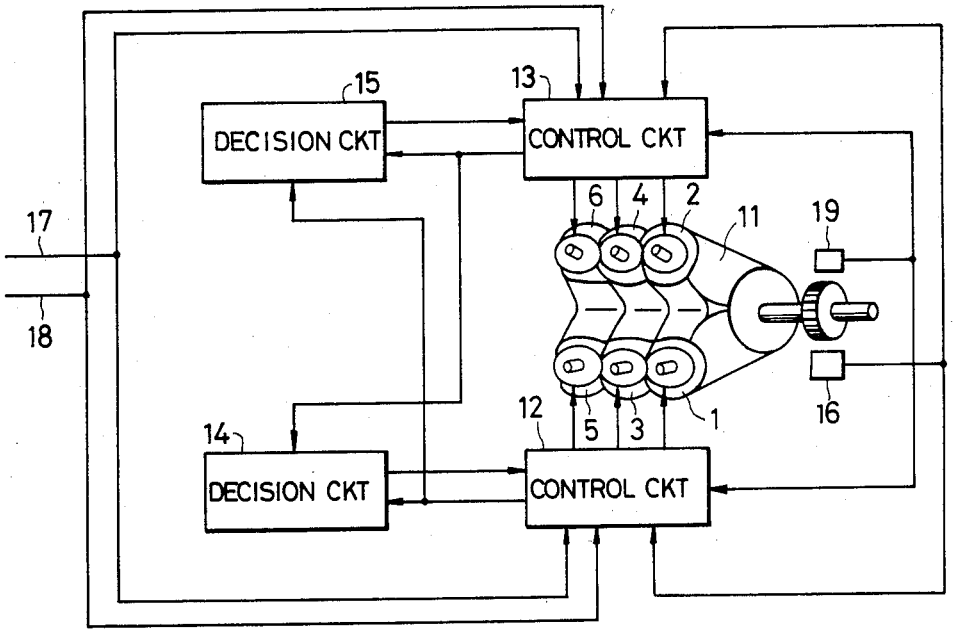
FIG. 1 shows the structure of an engine control system to which the present invention is applied.
Figure 2:
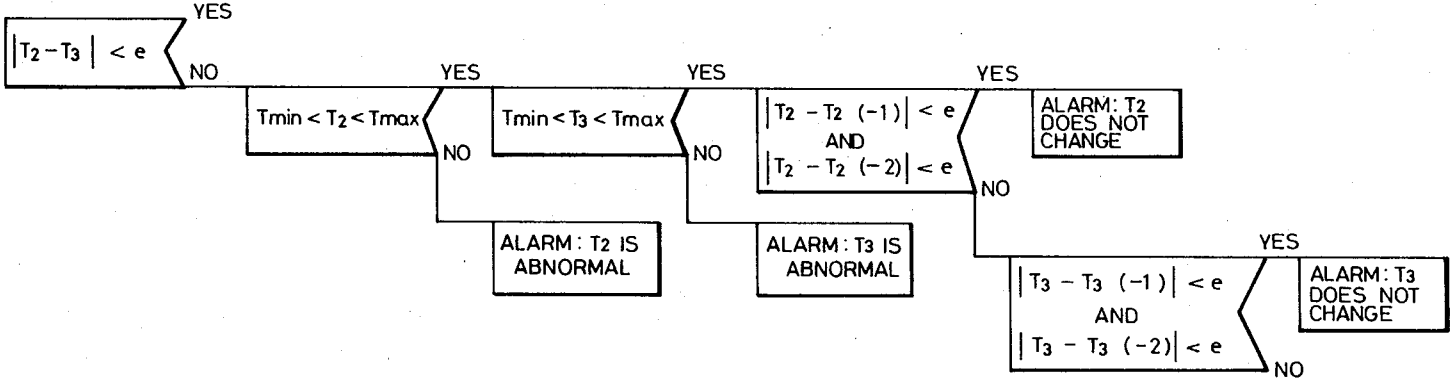
FIG. 2 is a flow chart which shows the operation and the process of a decision circuit.

An embodiment of the present invention will be described with reference to FIGS. 1 and 2. In FIG. 1, a 6-cylinder engine 11 having cylinders 1 to 6 is illustrated. Each cylinder is provided with an injector for fuel injection. The cylinders of the engine 11 are divided into two groups, and the amount of fuel injection and the injection timing of the cylinders 1, 3 and 5 are controlled by a control circuit 12, while those of the cylinders 2, 4 and 6 are controlled by a control circuit 13. The ignition system is the same as in the prior art. Each control circuit is different from a conventional electronic fuel injection control apparatus only in the following points. The input of a signal from each sensor and contents of carculation are approximately the same as conventional ones. Marked difference are that the ouptput torque in one cycle is equivalent to the output of half the cylinders and the timing process for it is therefore different, and that an interface unit for inputting/outputting the information to/from a decision circuit which decides normal/abnormality of the control circuit for controlling the other half cylinders is provided together with an information processing unit in order to prevent the engine from being stopped.

When both control circuits 12 and 13 are normal, the control circuit 12 controls the cylinders 1, 3 and 5 of odd numbers, while the control circuit 13 controls the cylinders 2, 4 and 6 of even numbers. Each control circuit detects the rotational speed of a shaft by a tachometer 16, a measured value 17 of air flow by an air flow meter (not shown), a cooling water temperature 18 by an engine cooling device (not shown), and other pieces of information (not shown) necessary for controlling the rotational frequency of the engine. Synchronization of the control circuits is carried out on the basis of the timing pulses which are synchronous with the rotation of the engine and which are detected by a timing pulse detector 19.

The normal or abnormality of the control circuits is decided by decision circuits 14 and 15 which are provided in correspondence to the respective control circuits. It is possible to incorporate the decision circuits into the respective control circuits. Each decision circuit fetches the calculated outputs of the control circuits 12 and 13, and judges whether there is a large difference between the calculated outputs of the control circuits 12 and 13. The process of decision is shown in FIG. 2. The fuel injection periods, which are the outputs of the control circuits 12 and 13, are assumed to be $T_2$ and $T_3$, respectively. If there is a large difference between the outputs of the circuits, namely, $T_2 - T_3 \geqq e$, one of the control circuits is out of order and the defective circuit delivers the output which is beyond the tolerance, or the output of one of the circuits is the same as the previous calculated output. In such case, that circuit is decided to be out of order. In FIG. 2, the symbol e denotes error, Tmin and Tmax the minimum value and the maximum value, respectively, of the injection period, and Ti (−j) a value of the injection time i obtained the period j before. The decision circuit gives information to the driver on which control circuit is decided to be out of order.

The driver manually cuts out the defective control circuit when he is informed of the defect of the control circuit, thereby stopping the supply of the fuel to the cylinders which are controlled by that control circuit. Simultaneously, he controls the remaining half cylinders by the normal control circuit. The manual cut-out is executed merely by designating the defective control circuit and switching in the interior of the car. That is, it is executed by cutting off the outputs of the other control circuit and the decision circuit which have been input to each control circuit by switching. Even if both control circuits are normal, it is possible to practice at driving with half the cylinders by cutting off one of the control circuits.

Although an injector is provided on each cylinder in this embodiment, it is possible to provide more than two injectors on a manifold and to provide a control circuit on each injector, providing slight modifications for the circuits.

According to this embodiment, even if a random failure is produced on a control circuit, it is possible to avoid the state in which driving is impossible by controlling half the cylinders by the other normal control circuit. This fact enables the driver to drive in an out-of-the-way place or carry a very important person without anxiety.

If a trouble is caused in a control circuit and the fact that the driver must cut out the circuit and drive thereafter with half the cylinders causes inconvenience to the driver, thereby urging the driver to replace the defective circuit, which leads to the emhancement of the reliability of the car.

Furthermore, since the driver can find the defective circuit easily, if the driver carries a spare control circuit (a printed circuit board), he can replace the printed circuit board in accordance with the instruction.

While there has been described what is at present considered to be a preferred embodiment of the invention, it will be understood that various modifications may be made thereto, and it is intended that the appended claims cover all such modifications as fall within the true spirit and scope of the invention.

What is claimed is:

1. A method of controlling an electronic fuel injection to an internal combustion engine comprising the steps of:

dividing a plurality of cylinders installed on said internal combustion engine into two groups;

providing a plurality of injectors on each group of cylinders, and dividing said injectors into two groups in correspondence with said two groups of cylinders;

providing two electronic circuits for controlling said two groups of injectors, respectively, comparing the calculated outputs of fuel injection supplied from said two electronic control circuits, respectively;

judging whether or not the operations of said two electronic circuit are normal on the basis of the result of comparison; and stopping the fuel injection which is controlled by the electronic circuit which has been judged to be abnormal, while continuing the fuel injection which is controlled by the electronic circuit which has been judged to be normal.

2. A method according to claim 1, wherein the results of calculation which are respectively output from said two electronic circuits are displayed to the driver and are judged by said driver whether or not the respective operations of said electronic circuits are normal.

* * * * *